US007527182B1

(12) United States Patent
Sherwood et al.

(10) Patent No.: US 7,527,182 B1
(45) Date of Patent: May 5, 2009

(54) LOWER LEG ARCHERY BOW SUPPORT

(75) Inventors: Eric P. Sherwood, Frankemuth, MI (US); Scott A. DeVuyst, Vassar, MI (US)

(73) Assignee: Get Outdoors Hunting L.L.C., Frankenmuth, MI (US)

( * ) Notice: Subject to any disclaimer, the term of this patent is extended or adjusted under 35 U.S.C. 154(b) by 727 days.

(21) Appl. No.: 10/988,096

(22) Filed: Nov. 12, 2004

Related U.S. Application Data

(60) Provisional application No. 60/523,549, filed on Nov. 20, 2003.

(51) Int. Cl.
*A45F 5/00* (2006.01)

(52) U.S. Cl. ..... 224/222; 224/268; 224/916

(58) Field of Classification Search ..... 224/222, 224/916, 200, 219, 268, 242
See application file for complete search history.

(56) References Cited

U.S. PATENT DOCUMENTS

| | | | | | |
|---|---|---|---|---|---|
| 1,689,051 | A | * | 10/1928 | Richardson et al. | 224/259 |
| 2,423,531 | A | * | 7/1947 | Theis | 224/182 |
| 2,715,990 | A | * | 8/1955 | Austin | 224/576 |
| 2,856,111 | A | * | 10/1958 | Wolfe et al. | 224/268 |
| 3,208,653 | A | * | 9/1965 | Wallace | 224/222 |
| 3,384,277 | A | * | 5/1968 | Hodelka | 224/242 |
| 3,465,928 | A | * | 9/1969 | Osterholm | 224/629 |
| 4,101,107 | A | * | 7/1978 | Antoszewski | 248/218.4 |
| 4,103,807 | A | * | 8/1978 | Lyon et al. | 224/222 |
| 4,628,893 | A | * | 12/1986 | Shaw, III | 124/23.1 |
| 4,681,246 | A | * | 7/1987 | Andersson | 224/267 |
| 5,309,328 | A | * | 5/1994 | Lum | 361/809 |
| D354,393 | S | * | 1/1995 | Mocca | D29/101.3 |
| 5,850,955 | A | * | 12/1998 | Barr | 224/222 |
| 6,021,768 | A | * | 2/2000 | Pomaville | 124/1 |
| 6,138,976 | A | * | 10/2000 | Fahringer, Sr. | 248/518 |
| 6,213,366 | B1 | * | 4/2001 | LaRocco | 224/666 |
| 6,217,072 | B1 | * | 4/2001 | Gregg | 280/823 |
| 6,267,276 | B1 | * | 7/2001 | Cook | 224/183 |
| 6,267,278 | B1 | | 7/2001 | Bogart | |
| 6,357,639 | B1 | | 3/2002 | Williams | |
| 6,523,183 | B1 | * | 2/2003 | Wright et al. | 2/227 |
| 6,557,739 | B1 | * | 5/2003 | Pursley et al. | 224/268 |
| D491,723 | S | * | 6/2004 | DeVuyst et al. | D3/221 |
| 7,290,689 | B2 | * | 11/2007 | Oxley | 224/270 |
| 2002/0053580 | A1 | * | 5/2002 | Charles | 224/222 |

* cited by examiner

*Primary Examiner*—Nathan J Newhouse
*Assistant Examiner*—Justin M Larson
(74) *Attorney, Agent, or Firm*—Reising Ethington P.C.

(57) ABSTRACT

A method of fabricating a bow supporter adapted to be worn on the lower leg of an archer above the archer's foot comprising providing a support base having a pocket forming member projecting forwardly for supporting the lower end of an archery bow; and providing a hook device having a terminal end projecting in an opposite direction relative to the pocket-forming member and defining a rearwardly open hook socket positioned for free receipt of a bow cable or string to cooperate with the pocket-forming member to support the bow from above the pocket-forming member in a rest position.

8 Claims, 4 Drawing Sheets

LOWER LEG ARCHERY BOW SUPPORT

REFERENCE TO CO-PENDING APPLICATION

This application derives priority from provisional application Ser. No. 60/523,549 filed Nov. 20, 2003.

TECHNICAL FIELD OF THE INVENTION

This invention relates to lower leg archery bow supports, and more particularly to a holder assembly utilizable particularly to support the lower end of a compound bow having an eccentric wheel or cam at the lower end thereof. The bow end holder is utilizable in conjunction with an open readily disengaged member for capturing either the bow cable or the bow string. While leg supported holders are known, and I refer particularly to U.S. Pat. No. 6,267,278, issued Jul. 31, 2001, the present invention is considered to have additional advantages which will be well appreciated by archers.

SUMMARY OF THE INVENTION

The bow holder assembly comprises a bow lower end holder and an upper rearwardly open cable or bow string brace strapable in position on the lower leg of an archer enabling removal of the cable or bow string from the brace by simply tilting the bow in a reward direction.

PRESENTLY PREFERRED OBJECTS OF THE INVENTION

One of the prime objects of the present invention is to fabricate a relatively simple bow support device adapted to be worn on the lower leg of the archer below the knee and preferably positioned such that it does not have elements extending above the knee which might interfere with the wearer moving through forest brush or climbing to a tree stand.

Another object of the invention is to minimize the movement of the archer and provide cable or bow string retention mechanism which is rearwardly open and permits the cable or string to be readily removed by simply tilting the bow slightly in a rearward direction.

A further object of the invention is to design a holder of the character illustrated, which has elements which can be preferably strapped to the inner side of the leg of a right-handed archer, or alternatively the exterior side of a left-handed archer or vice versa.

Still a further object of the invention is to design a bow support capable of holding the cam on a compound bow while, at the same time, releasably bracing the bow cable or bow string in a manner which permits disengagement by simply tilting the bow to move the cable or string to released position with a minimum of movement and without any audible noise.

A further object of the invention is to provide a bow holder which permits a sitting/standing archer to have a hand or hands free while attending a bow in an upright position.

A further object of the invention is to provide a bow support which permits the archer to support the bow in a virtually ready position, awaiting full draw and release of the arrow.

Still a further object of the invention is to provide a holder of uncomplicated and reliable construction which is relatively easy and economical to fabricate.

The bow holder assembly comprises a bow end holder and an open cable or bow string brace strapable in position on the lower leg of an archer.

Further advantages of the invention will be apparent to those skilled in the art with a further understanding of the bow holder and the manner in which it is worn and used and other objects, features and structure advantages will become more readily apparent in view of the following detailed description along with the appended claims and accompanying drawings.

DETAILED DESCRIPTION OF THE DRAWINGS

Figure 1:
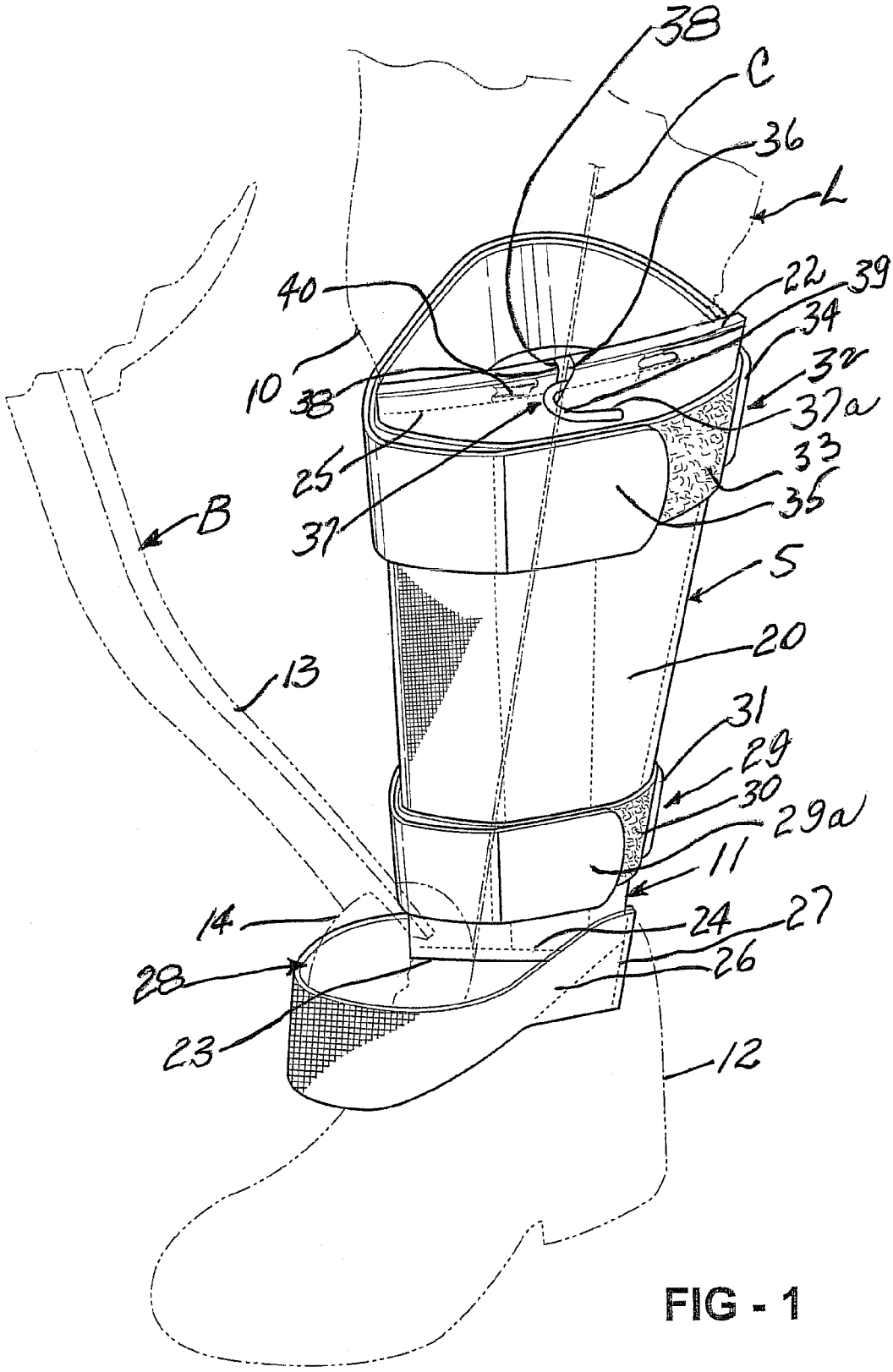
FIG. 1 is a perspective elevational view of the bow rest assembly in bow supporting position on the side of the leg of an archer.

Referring now more particularly to the drawings, and in the first instance to FIG. 1, the leg L of an archer is illustrated in phantom lines as including a knee portion 10 and a lower leg portion 11 on which our novel bow supports or archery bow supported mounts, above a boot or shoe 12. Also shown in phantom lines is a typical compound bow, generally designated B, including a lower limb portion 13 which may mount an eccentric wheel or cam 14 in the conventional manner.

Figure 2:
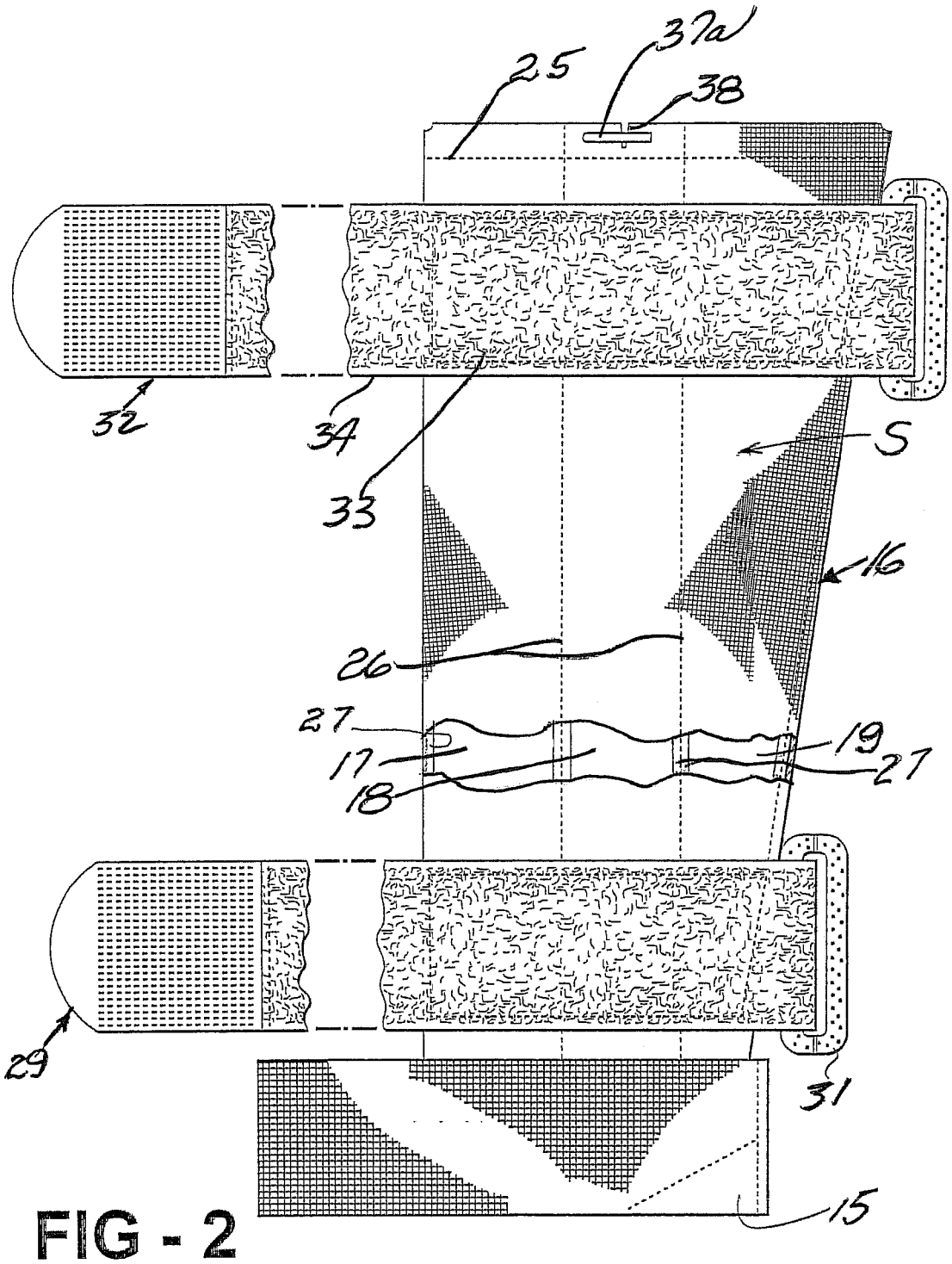
FIG. 2 is a side elevational view thereof.

As FIG. 2 indicates also, a lowermost webbing fabric loop shaped band or bow receipt, pocket-forming member 15 is sewn or otherwise fixed to the fabric sheathed base support assembly 16 of our bow holder to provide a laterally closed loop on the lower end of the base 16 to receive and support the larger diameter eccentric 14.

Figure 4:
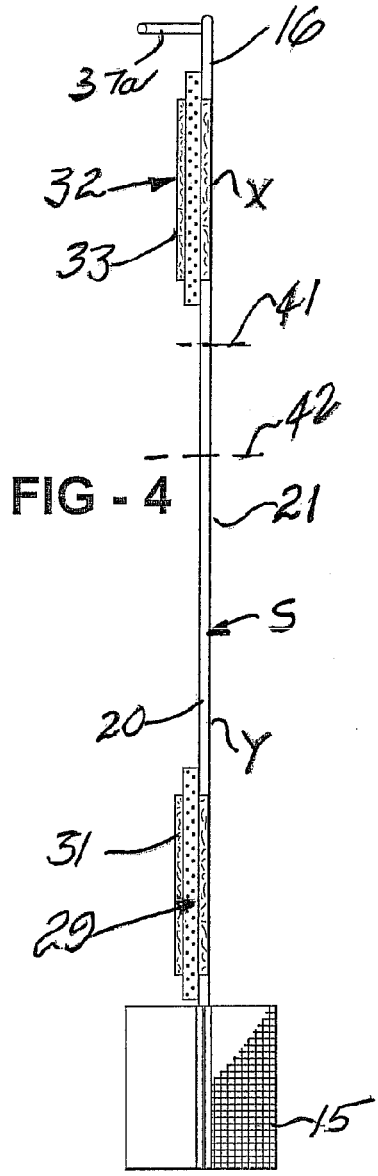
FIG. 4 is a front elevational view thereof.
Figure 5:
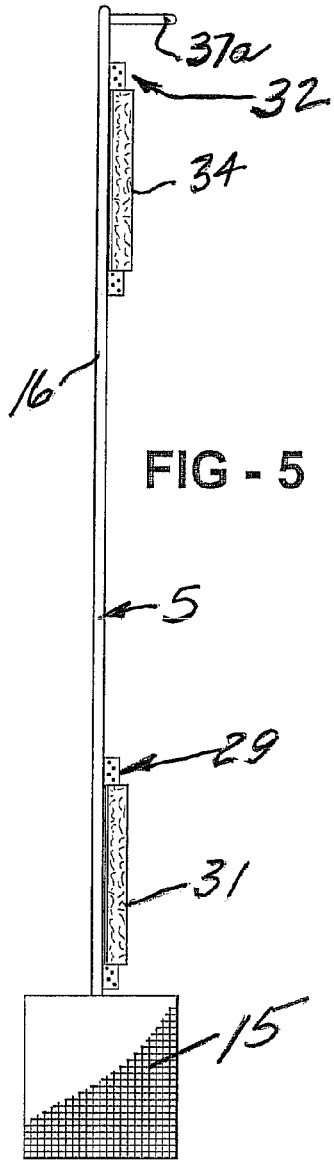
FIG. 5 is a rear elevational view thereof.
Figure 6:
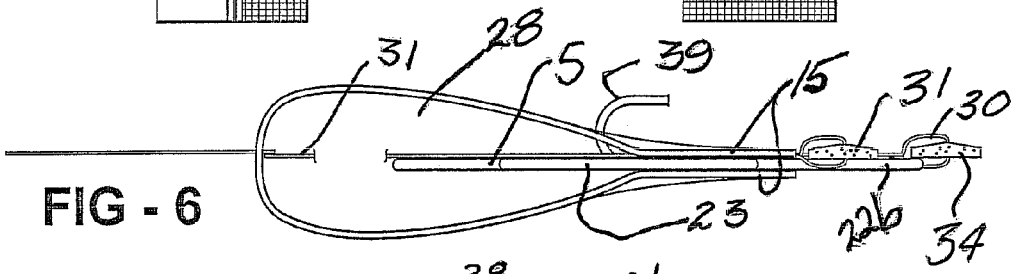
FIG. 6 is a under plan view thereof.
Figure 7:
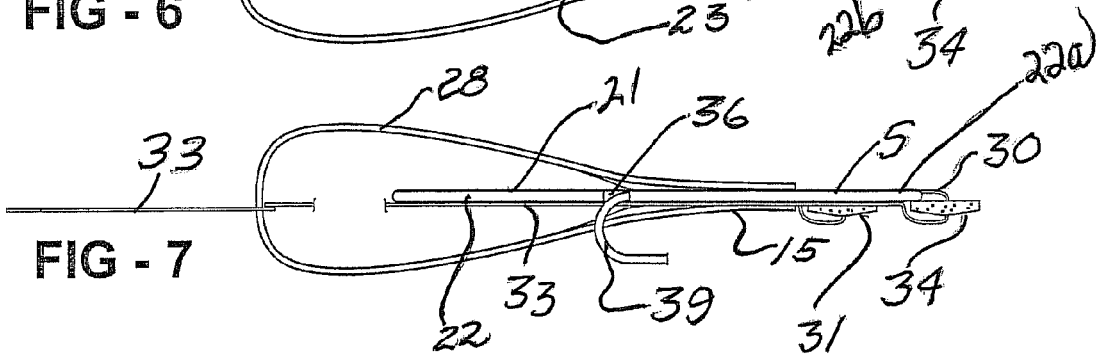
FIG. 7 is a top plan view thereof.

In FIG. 4, the band 15 is shown as sewn at its rear ends to the lower end of the support base assembly 16. Base 16 preferably includes flexible plastic splints 17-19 (FIG. 2) encased in a camouflage fabric base, envelope or sheath S which, as illustrated, is generally downwardly convergent in character, but need not be. The fabric base or envelope S has an exterior side 20 and an interior side 21, bounded by closed front and rear edges 22 and 23. The envelope also has closed upper and lower ends 22*a* and 23*a*. In the case of the upper end, the envelope S is closed by folding the upper end of interior side 21 over the top of side 20 and hemming it as at 24. The lower end is closed by hemming it as at 25. The splints 17-19 at their upper ends terminate just short of the hem line 24 and, at their lower ends, just short of the hem line 25. As illustrated, the splints 17 and 18 are of uniform width and the splint 19 tapers downwardly at one side. It is to be understood that the shape of these resilient flexible splints or sticks, and their number, may vary within the scope of the present invention. Stitching 26 extends through both sides 20 and 21 of the sheath S to form vertically extending pockets 27 for the splints 17-19.

As shown in FIG. 2, the pockets 27 are of such extra lateral width that splints 17 and 19 can hinge about stitch lines 26 and the base 16 can laterally slightly curve to more nearly conform to the leg of the archer.

At the lower end of the sheath S, strap or band 15 is sewn to the envelope S at its ends, as at 27, to form the open ended pocket or socket 28 which is sized to receive and support the lower end of a bow cam or the like as shown in FIG. 1. A lower strap device, generally designated 29, comprised of a fabric webbing belt with an external Velcro side 30 is sewn to the sheath or envelope S and includes a belt eye link 31 secured to the envelope S by the portion of the strap 29 which is sewn to the base sheath or envelope 16. After wrapping around the envelope S and the lower portion of the archer's leg, the free end of the strap 29*a* is Velcro-held securely on the leg L of the archer. Other strap devices such as elastic bands or the like are, of course, possible. A similar leg strap device or encircler 32 is sewn to the upper end of the envelope 16 below the hem line 25 and includes a like Velcro exterior portion 33, eye link 34, and a free end 35 which is Velcro-secured in position in the same way to hold the upper end of the envelope sheath S in position.

Figure 3:
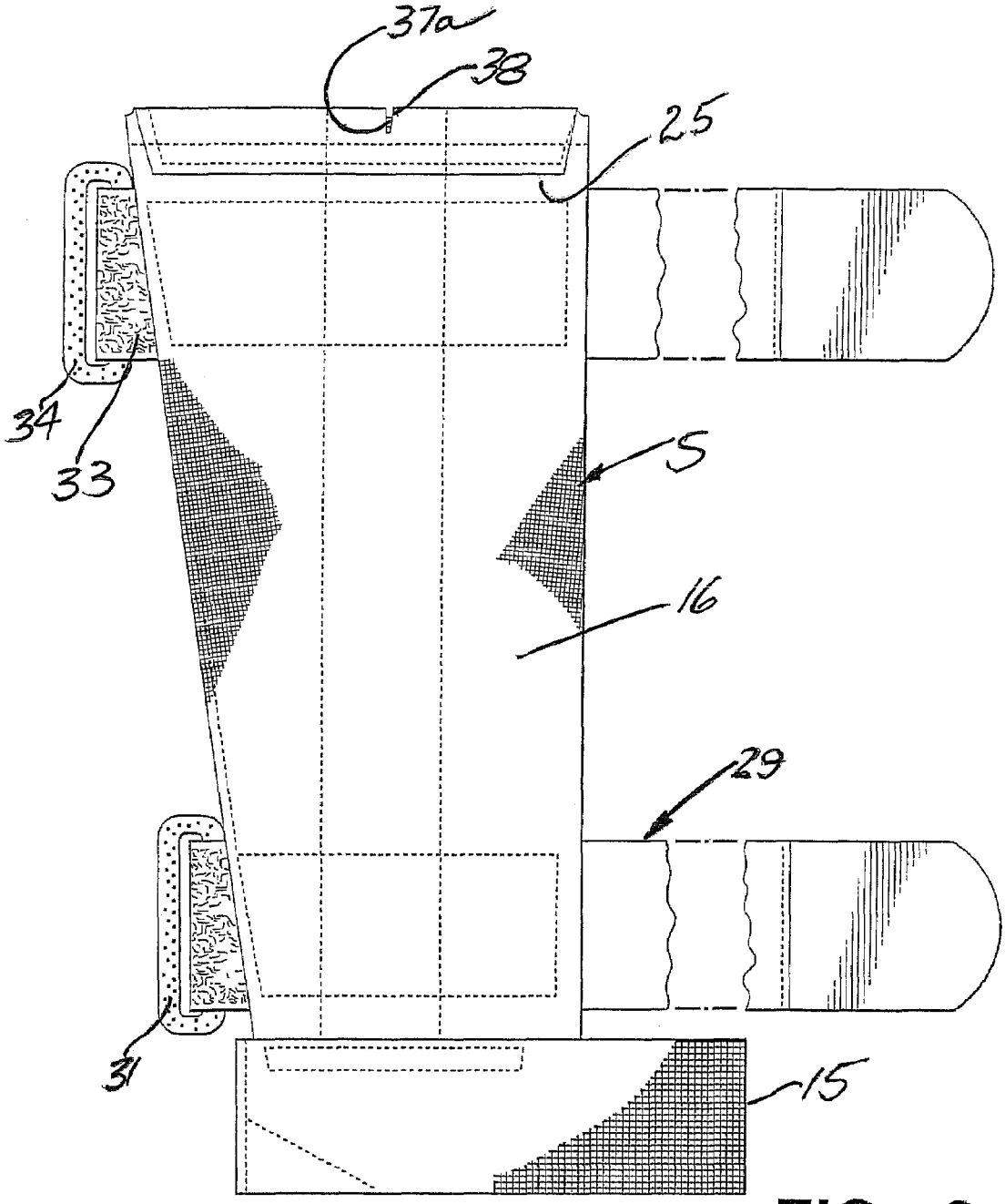
FIG. 3 is an opposite side elevational view thereof.

At its upper end, the spaced down hemming 25 provides an elongate crosswisely-extending upper end pocket or receptacle, designated 36, for reception of a rearwardly open bow string or cable retainer member generally designated 37. The pocket or receptacle 36 is accessible via a slit 38 extending from one side 20 to the other side 21 across the top of the base which permits hook part or terminal leg 37*a* to protrude its free end to extend rearwardly in a direction opposite to the extension of band member 15 which is secured at its rear ends and extends forwardly. The retainer member or hook devise 37 includes integrated oppositely extending lateral legs including mid-leg portion 39 and leg portion 40 which extend first rearwardly and then forwardly of hook part 37*a* respectively in the receptacle 36 substantially to the closed ends of the receptacle 36 to hold the hook portion 37*a* in position. The slit portion 38 extends through the upper end of the receptacle 36 through sides 20 and 21 as shown in FIG. 3, permitting the member 37 with protruding leg 37*a* to be rotated in receptacle 36 so that the hook part 37*a* can be disposed in 270 degree rotated position flush with and on the interior side of the base S when the archer is walking through brush and does not wish to have the hook end 37*a* exposed.

The Operation

In practice, a right handed archer straps the sheath device to the interior side of his lower right leg below the knee and, after having settled in a seated or near-seated position, moves the bow B to position the cam 14 within supporting loop 28, while tilting or pivoting the bow forwardly about its lower end so that the bow cable C, or bow string, as the case may be, braces on and is retained within the hook 37*a*. When the weight of the bow is so supported on the leg L of the archer, it will be supported in a manner which frees the hands of the archer. It is a relatively simple matter then to release the cable C or bow string from the hook 37*a* by simply tilting the bow rearwardly slightly about its lower end, without any audible noise which would alert the game, to remove it from hook 37*a*.

It is to be understood that the retainer or hook device with band 37 may be supplied separately from the member providing support for the lower end of the bow. For example, FIG. 4 illustrates an alternative embodiment in which the upper end of the device is separated from the lower end of the device by the space indicated in chain lines at 41 and 42, with the device then divided into two separate parts. Alternately, of course, any mechanisms or devices may be used, other than the bands 29 and 32, to mount these separate devices in assembly position on the lower leg of the archer. In this version of the invention the pockets 27 for the splints 17-19 would be provided in the lower portion X (see FIG. 4) of the support base assembly in the manner indicated and the band or strap 32 would be fixed on the upper part Y.

The integrated device is preferred because it maintains the spatial vertical and lateral relationship of the member 37*a* with relation to the loop 28. It is to be understood that various forms of the invention and various embodiments thereof may be utilized within the scope of claims to be ultimately granted.

We claim:

1. A lower leg-secured archery bow supporter adapted to be worn on the side of the lower leg of an archer above his or her foot and compromising:

a support base assembly extending upwardly above the ankle to lie along the archer's calf;

a fastener assembly for retaining the base assembly on the calf of the archer;

a pocket forming device adapted for removably receiving the lower end of the bow extending forwardly from the base assembly and the lower leg of the archer; and a hook device comprising:

a rearwardly extending terminal end defining an open hook socket positioned for free receipt of a bow cable or bow string from the rear to cooperate with the pocket to support the bow from above the pocket forming device, and for release of the bow cable or bow string by simply pivoting the bow lower end in a rearward arc to swing the bow cable or string to a position rearward of the hook socket; and a wire with the rearwardly extending terminal end joined to a mid-leg portion extending parallel to the terminal end and spaced therefrom to form an opposite portion of the hook socket;

the mid-leg portion being joined to a forwardly extending leg received by the support base assembly; and the support base assembly comprising a pliable material base hemmed at its upper end to provide a front to rear extending pliable material upper receptacle in which the mid-leg portion and forwardly extending leg are housed in the pliable material support receptacle, the pliable material support base being slit rearwardly of the front end of the forwardly extending leg to permit the hook terminal end portion to protrude sidewisely from the pliable material receptacle and pivot.

2. The bow supporter of claim 1 wherein said hook device is swivelly mounted to swing about a front to rear axis vertically to lie against said support base assembly.

3. The bow supporter of claim 1 wherein said pliable material base is formed of an inner and an outer pliable material secured together along their upper, lower, and front and rear edges, and said fastener assembly includes a band secured to said support base assembly for encircling the archer's leg.

4. The bow supporter of claim 3 wherein said pliable material base is fabricated to provide vertically extending splint pockets between said front and rear edges and flexible, vertically extending, splints are received therein to function as rigidifiers which can move relative to one another to conform the base to the curvature of the archer's leg.

5. The bow supporter of claim 1 wherein said support base assembly includes an upper end mounting said hook device and said fastener assembly includes a strap for securing said hook device in position on the archer's leg.

6. The bow supporter of claim 5 in which said support base assembly is comprised of two separate pieces spaced vertically from one another with said bow pocket-forming device carried by a lower piece of the two separate pieces and said hook device carried by an upper piece of the two separate pieces.

7. A method of fabricating a bow supporter adapted to be worn on the lower leg of an archer above the archer's foot comprising:

providing a support base having a pocket forming member projecting from the lower end thereof for supporting the lower end of an archery bow; and providing a hook device having a terminal end projecting in an opposite direction relative to said pocket-forming member and defining a rearwardly open hook socket positioned for free receipt of a bow cable or string to cooperate with the said pocket-forming member to support the bow from above said pocket-forming member in a rest position, and for release of the bow cable or bow string by simply pivoting the bow lower end in an arc to swing the bow cable or string to a position out of said hook socket, the hook device being provided as a wire with the terminal end joined to a mid-leg portion paralleled to the terminal end and spaced therefrom to form an opposite portion of the hook socket, the mid-leg portion being joined to a forwardly extending leg support by the support base assembly, and the support base assembly is provided as a pliable material base configured at its upper end to provide a front to rear extending pliable material upper receptacle in which the mid-leg portion and forwardly extending leg are received within the pliable material upper receptacle, the pliable material upper receptacle being slit rearwardly of the front end of the forwardly extending leg to permit the hook terminal end portion to protrude sidewisely from the pliable material upper receptacle.

8. The method of claim 7 wherein said support base assembly is provided as a pliable material base providing vertically extending splint pockets between said front and rear edges and flexible, vertically extending, splints are placed therein to function as rigidifiers which can move relative to one another to conform the pliable material base to the curvature of the archer's leg.

* * * * *